US008292128B2

(12) United States Patent
Hagleitner

(10) Patent No.: US 8,292,128 B2
(45) Date of Patent: Oct. 23, 2012

(54) DISPENSER FOR FOAMED SOAP

(76) Inventor: Hans Georg Hagleitner, Zell Am See (AT)

( * ) Notice: Subject to any disclaimer, the term of this patent is extended or adjusted under 35 U.S.C. 154(b) by 229 days.

(21) Appl. No.: 12/941,139

(22) Filed: Nov. 8, 2010

(65) Prior Publication Data

US 2011/0101031 A1 May 5, 2011

Related U.S. Application Data

(63) Continuation of application No. PCT/AT2009/000148, filed on Apr. 15, 2009.

(30) Foreign Application Priority Data

May 6, 2008 (AT) ..... A 730/2008

(51) Int. Cl.
*B67D 7/76* (2010.01)

(52) U.S. Cl. ..... 222/190; 222/63

(58) Field of Classification Search ..... 222/190, 222/333, 63, 1, 181.1, 181.3, 382.2, 136, 222/145.5

See application file for complete search history.

(56) References Cited

U.S. PATENT DOCUMENTS

| | | | | |
|---|---|---|---|---|
| 3,049,267 | A * | 8/1962 | Edwards et al. | 222/134 |
| 3,081,909 | A * | 3/1963 | Hooker | 222/1 |
| 3,239,100 | A * | 3/1966 | Peterson | 222/57 |
| 4,405,489 | A * | 9/1983 | Sisbarro | 516/109 |
| 5,906,299 | A | 5/1999 | Hagleitner | |
| 8,230,820 | B2 * | 7/2012 | Hiley et al. | 119/670 |
| 2004/0177975 | A1 * | 9/2004 | Laskaris et al. | 169/13 |
| 2005/0139612 | A1 | 6/2005 | Matthews et al. | |
| 2008/0277421 | A1 * | 11/2008 | Zlatic et al. | 222/136 |

FOREIGN PATENT DOCUMENTS

| | | | |
|---|---|---|---|
| WO | 96/29921 | A1 | 10/1996 |
| WO | 2005/063105 | A1 | 7/2005 |

* cited by examiner

*Primary Examiner* — Lien Ngo
(74) *Attorney, Agent, or Firm* — Laurence A. Greenberg; Werner H. Stemer; Ralph E. Locher

(57) ABSTRACT

A dispenser for foamed soap contains a housing accommodating a soap container and a foam-producing unit. A first pump is provided in a delivery path of the soap from the container to a foam-producing unit. A second pump is provided in the delivery path of air to the foam-producing unit. Every pump is associated with a respective electric motor and has a control which can be used to adjust the ratio of the delivery volumes of air and soap by changing the speed of one of the two electric motors.

10 Claims, 2 Drawing Sheets

DISPENSER FOR FOAMED SOAP

CROSS-REFERENCE TO RELATED APPLICATION

This is a continuation application, under 35 U.S.C. §120, of copending international application No. PCT/AT2009/000148, filed Apr. 15, 2009, which designated the United States; this application also claims the priority, under 35 U.S.C. §119, of Austrian patent application No. A 730/2008, filed May 6, 2008; the prior applications are herewith incorporated by reference in their entirety.

BACKGROUND OF THE INVENTION

Field of the Invention

The invention relates to a dispenser for foam soap, having a housing in which a soap container and a foam generator are provided, with a first pump being provided in the delivery path for the soap from the container to the foam generator, and a second pump being provided in the delivery path for the air to the foam generator.

A soap dispenser of this kind is disclosed, for example, in international patent disclosure WO 96/29921, corresponding to U.S. Pat. No. 5,906,299. In that document, two reciprocating piston pumps are arranged parallel one above the other in the dispenser and can be operated by a common operating lever. Soap and air are simultaneously pushed into a foam chamber at the outlet, thoroughly mixed and dispensed as soap foam of unvarying consistency.

A similar dispenser, which contains two rotary pumps, is described in international patent disclosure WO 2005/063105, corresponding to U.S. patent publication No. 2005/0139612. The two rotary pumps are operated by a common manual lever by a gear mechanism. Different consistencies of foam can be achieved by virtue of different gear transmission ratios; details about this are not given.

For the sake of simplicity, the following description and the appended claims discuss "foam soap" and "soap", these terms covering all foamable cleaning, disinfecting and care products.

SUMMARY OF THE INVENTION

It is accordingly an object of the invention to provide a dispenser for foamed soap which overcomes the above-mentioned disadvantages of the prior art devices of this general type, in which the dispenser is configured in such a way that the consistency of the foam can be easily adjusted and changed over a specific range as required.

With the foregoing and other objects in view there is provided, in accordance with the invention a dispenser for foam soap. The dispenser contains a housing, a soap container for soap disposed in the housing, a foam generator disposed in the housing, a first pump disposed in a first delivery path for the soap from the soap container to the foam generator, and a second pump disposed in a second delivery path for air to the foam generator. The first and second pumps each have an associated electric motor. A control system is provided for adjusting a ratio of delivery volumes of the air and the soap by changing a rotation speed of one of the two associated electric motors.

According to the invention, the object is achieved in that each pump has its own associated electric motor, and a control system is provided, it being possible to use the control system to adjust the ratio of the delivery volumes of air and soap by changing the rotation speed of one of the two electric motors. Therefore, use is made, in particular, of DC motors, the rotation speed of the DC motors being directly proportional to the motor voltage.

Changing the consistency of the foam first allows a fixed minimum dispensing quantity, for example of a disinfecting cleaning liquid, to be adjusted, and second allows a greater quantity of soap foam to be provided in the case of heavy soiling and allows a reduced quantity of soap foam to be provided in the case of light soiling, and in the process in each case leaves the portion of soap dispensed and the time at which soap is dispensed virtually unchanged.

The mixing ratio influences the firmness of the foam.

In a preferred embodiment, provision is therefore made for it to be possible for the volume ratio to be adjusted by changing the rotation speed of the motor for the soap pump. Therefore, the rotation speed of the motor for the air pump remains constant in this embodiment. Preferred dispensing quantities of foamed cleaning liquid are approximately 0.3 ml in one second and an approximate volume ratio of 50:1 to approximately 0.9 ml in 1.5 seconds and an approximate volume ratio of 50:2—very wet foam.

The dispenser according to the invention can be provided with a connection to the local power supply system, however, the dispenser can also be autonomous of the local power supply system and have integrated power sources, such as batteries, rechargeable batteries or the like. In order to provide a constant voltage to the motor for the air pump, so that the delivery quantity of the pump remains the same, the integrated power source further preferably has an associated voltage stabilization circuit in this case.

The two pumps can be of any desired type, provided that they can be driven by the electric motor. The air pump is preferably a diaphragm pump. Pumps of this kind, which are particularly suitable for the specific purpose of delivering air, are included in groups F04B43/02 and F04B43/04 of the International Patent Classification. A peristaltic pump, as included in group F04C5/00 of the International Patent Classification, is a particularly suitable soap pump.

Other features which are considered as characteristic for the invention are set forth in the appended claims.

Although the invention is illustrated and described herein as embodied in a dispenser for foamed soap, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
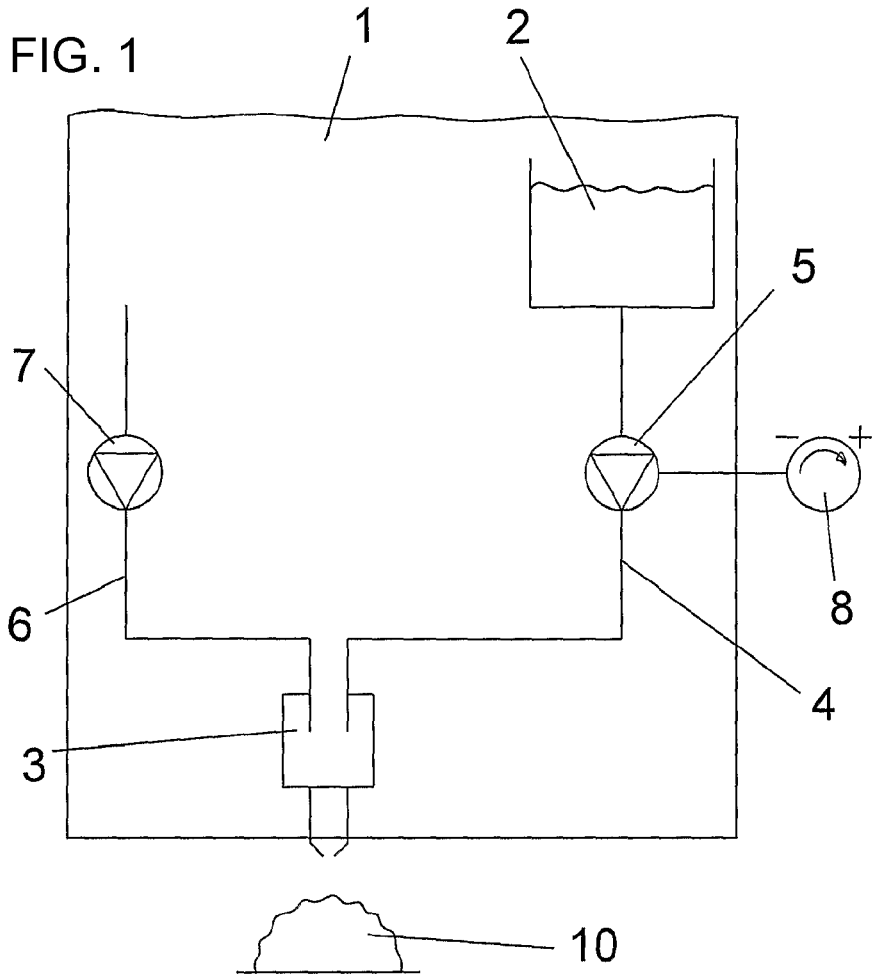
FIG. 1 is a schematic illustration of parts of a dispenser for foam soap which are relevant to the invention.
Figure 2:
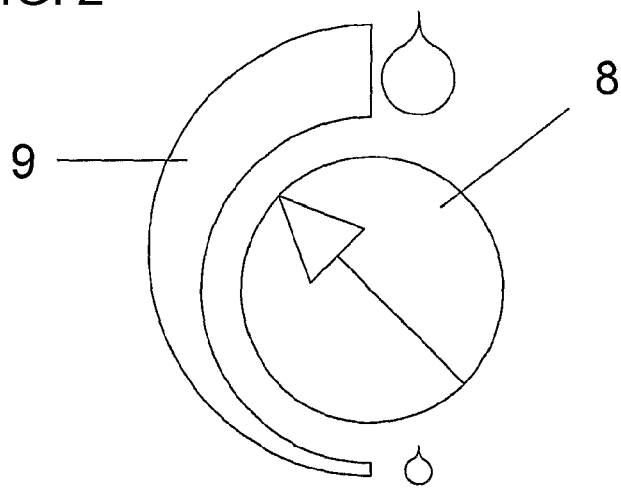
FIG. 2 is an enlarged illustration of a handle for adjusting a air/soap ratio.

Referring now to the figures of the drawing in detail and first, particularly, to FIG. 1 thereof, there is shown a dispenser according to the invention for a foamed medium, in particular for foam soap. The dispenser contains a housing 1 which has an, in particular replaceable, soap container 2 and a foam generator 3 at the bottom. The foam generator can have, for example, a porous insert body or at least two screens which are arranged one behind the other. Numeral 10 denotes a portion of the foam which is produced. A line 4 extends from the soap container 2 to the foam generator 3, the line contains a soap pump 5 which is driven by an electric motor, in particular a peristaltic pump, of which the rotation speed can be varied by a rotary potentiometer 8. The rotary head of the potentiometer 8 is preferably provided with an associated pictogram, for example of the type shown in FIG. 2, on the housing, a scale 9 indicating the quantity of soap delivered.

Furthermore, a line 6 for feeding air issues into the foam generator 3, the line 6 contains an air pump 7 which is driven by a second electric motor, in particular a rotary diaphragm pump. The dispenser preferably has a non-illustrated proximity sensor, and therefore the two pumps 5, 7 begin to run when a hand is correctly positioned beneath the outlet of the foam generator 3.

The quantity of delivered air is kept constant, that is to say the rotation speed of the air pump 7 is not changed. The soap component, which influences the consistency of the foam, can be varied by changing the rotation speed of the soap pump 5.

FIG. 1 shows the rotation speed control system for the soap pump 5 from outside the housing 1. However, the rotary knob of the potentiometer 8 can also be arranged within the interior of the housing, with a housing cover which may be blocked having to be opened. This embodiment permits the consistency of the soap foam to be changed only by authorized users, for example service personnel.

Figure 3:
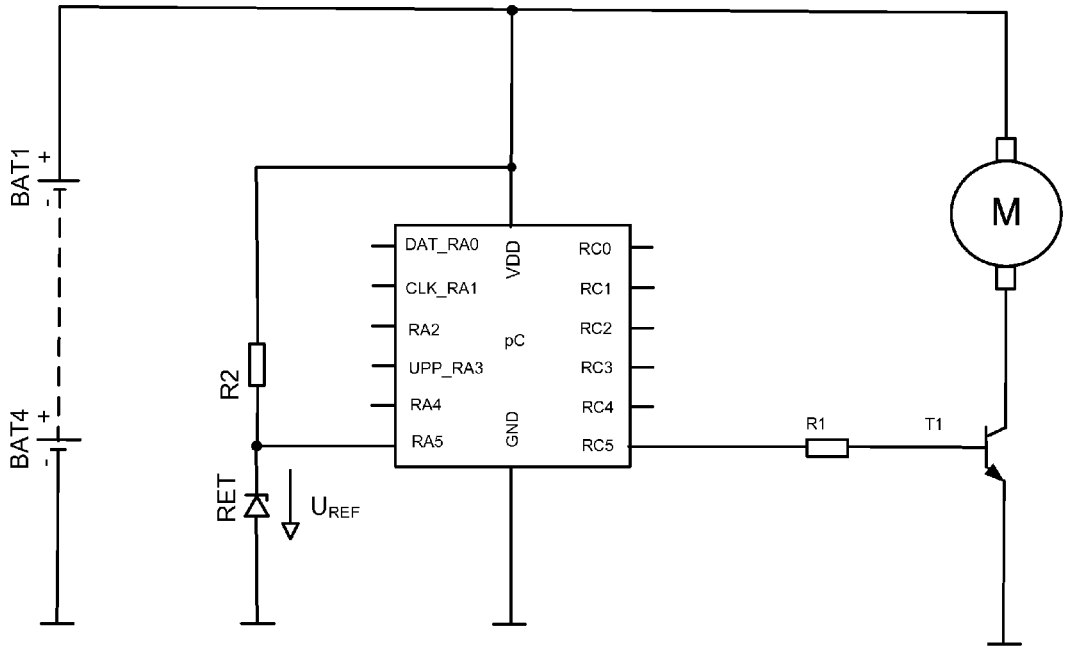
FIG. 3 is a circuit configuration for stabilizing a voltage which is output by batteries.

The dispenser can be connected to the local power supply system or have an internal power source. In the case of an internal power source, for example four alkaline batteries, the battery voltage drops from 6.4 V to 4 V with continued use. Therefore, an internal power source is provided with, in particular, associated voltage stabilization by pulse-width modulation (FIG. 3), and DC motors are used, the motor voltage of the DC motors being established close to the lower limit of the battery voltage, and therefore the predefined rotation speeds of the two pumps 5, 7 can be maintained almost until the internal power source is depleted. As shown in FIG. 3, a controller (μC) compares the supply voltage with the reference voltage $U_{ref}$ of a reference diode—that may also be an internal reference—and regulates the pulse-width modulation (PWM) of the motor M at 4 V. An output transistor or (MOS-Fet) T1 serves as a driver in order to provide the requisite current for the motor.

The invention claimed is:

1. A dispenser for foam soap, the dispenser comprising:

a housing;

a soap container for soap disposed in said housing;

a foam generator disposed in said housing;

a first pump disposed in a first delivery path for the soap from said soap container to said foam generator;

a second pump disposed in a second delivery path for air to said foam generator, said first and second pumps each having an associated electric motor; and a control system for adjusting a ratio of delivery volumes of the air and the soap by changing a rotation speed of one of said two associated electric motors.

2. The dispenser according to claim 1, wherein the ratio can be adjusted by changing the rotation speed of said electric motor for said first pump being a soap pump.

3. The dispenser according to claim 2, wherein said control system has a potentiometer, the rotation speed of said electric motor of said soap pump can be adjusted by said potentiometer.

4. The dispenser according to claim 1, wherein the ratio being a volume ratio of the air to the soap and can be varied between 10:1 and 75:1.

5. The dispenser according to claim 1, wherein a delivery volume of said second pump being an air pump is approximately 15 ml/sec.

6. The dispenser according to claim 2, wherein a delivery volume of said soap pump can vary between 0.3 and 0.6 ml/sec.

7. The dispenser according to claim 1, further comprising:

batteries; and a voltage stabilization circuit for keeping the rotation speed of said electric motor of said second pump constant being associated with said batteries.

8. The dispenser according to claim 1, wherein said second pump is a diaphragm pump.

9. The dispenser according to claim 1, wherein said first pump is a peristaltic pump.

10. The dispenser according to claim 1, wherein the ratio is a volume ratio of the air to the soap and can be varied between 25:1 and 50:1.

* * * * *